US007637570B2

(12) United States Patent
Becker et al.

(10) Patent No.: US 7,637,570 B2
(45) Date of Patent: Dec. 29, 2009

(54) CHAIR

(75) Inventors: Erich Becker, Springe (DE); Heiko Buettner, Hannover (DE); Carsten Gehner, Hannover (DE)

(73) Assignee: Wilkhahn Wilkening + Hahne GmbH + Co., Bad Münder (DE)

( * ) Notice: Subject to any disclaimer, the term of this patent is extended or adjusted under 35 U.S.C. 154(b) by 16 days.

(21) Appl. No.: 12/015,214

(22) Filed: Jan. 16, 2008

(65) Prior Publication Data

US 2008/0169693 A1 Jul. 17, 2008

(30) Foreign Application Priority Data

Jan. 16, 2007 (DE) ..... 10 2007 002 284

(51) Int. Cl.
*A47C 1/022* (2006.01)

(52) U.S. Cl. ..... 297/314; 297/312

(58) Field of Classification Search ..... 297/312, 297/313, 314

See application file for complete search history.

(56) References Cited

U.S. PATENT DOCUMENTS

| | | | | |
|---|---|---|---|---|
| 5,713,632 | A | 2/1998 | Su | |
| 6,595,586 | B2 * | 7/2003 | Brightbill et al. | 297/312 |
| 7,350,865 | B2 * | 4/2008 | Pearse | 297/312 X |
| 7,387,339 | B2 * | 6/2008 | Bykov et al. | 297/312 X |
| 2007/0273190 | A1 | 11/2007 | Gehner | |

FOREIGN PATENT DOCUMENTS

| | | |
|---|---|---|
| EP | 1051931 | 11/2000 |

* cited by examiner

*Primary Examiner*—Anthony D Barfield
(74) *Attorney, Agent, or Firm*—Stites & Harbison PLLC; Ross F. Hunt, Jr.; Douglas E. Jackson

(57) ABSTRACT

The chair according to the invention has a seat and a seat mechanism, wherein the seat and the seat mechanism are formed so that, during the sideways pivoting movement of the seat, the one side of the seat is movable independently of the other side of the seat, wherein the seat is mounted so as to be pivotable about a pivoting or rotation axis lying parallel to the knee axis of the user.

16 Claims, 15 Drawing Sheets

CHAIR

Figure 1A:
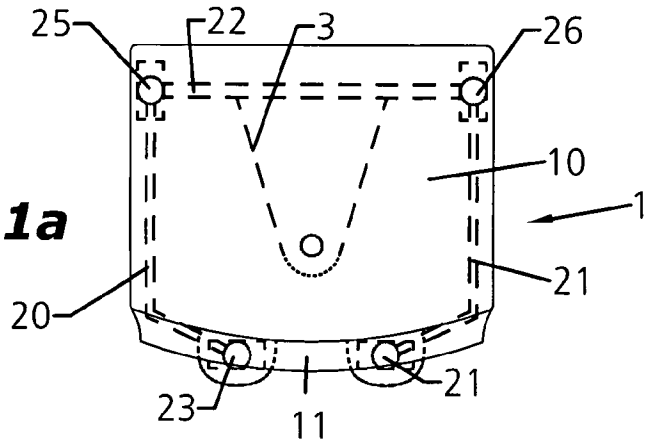

The invention relates to a chair with a seat and a seat mechanism, wherein the seat mechanism permits a sideways pivoting movement of the seat.

Designs which permit all-round pivotability of the seat are known from practice. In this case, the pivoting joint is arranged centrally in the vicinity of the vertical centre axis through the seat surface (see for example EP-B-1 051 931). However, this design of the mechanism has the disadvantage that the sitting action requires the constant co-operation of the user in order prevent unwanted tilting. Although the flexibility can often be adjusted in its hardness, the freedom of movement and thus the adaptation to the body movements of the user are restricted as a result.

U.S. Pat. No. 5,713,632 discloses a chair which has two seat halves which are each pivot able about an axis extending approximately parallel to the thigh of a user. This chair is intended to allow a user to sit comfortably also for a relatively long period of time.

On the basis of this prior art, the object of the invention is to develop a new movement design which on the one hand permits a sideways pivoting movement of the seat, but nevertheless also imparts sufficient safety and stability to the user in the upright position.

According to the invention, this object is achieved by the features of claim 1.

In particular, the chair according to the invention has a seat and a seat mechanism, wherein the seat and the seat mechanism are formed so that, during the sideways pivoting movement of the seat, the one side of the seat is movable independently of the other side of the seat, and wherein the seat is mounted so as to be pivotable about a pivoting or rotation axis lying parallel to the knee axis of the user.

In contrast to the designs pursued hitherto, in which the entire seat and, in particular, the entire seat surface is formed as a rigid component which tilts towards the left or the right, the seat according to the invention should be formed so that the left and right sides of the seat are movable independently of one another. A chair of this type is capable of following the natural three-dimensional movements of the user, while still providing sufficient safety in the upright position.

Further configurations of the invention form the subject-matter of the sub-claims.

According to a preferred embodiment, the seat has a seat surface and a backrest, wherein the backrest and the seat surface are movable relative to one another.

According to a first embodiment, the seat mechanism has two lateral supporting arms which react independently of one another and to which the seat is fastened. The two supporting arms are preferably pivotably mounted in the region of the knee axis of a user. The seat can be connected to the supporting arms by means of ball joints, for example, wherein a first and a second ball joint can be arranged in the lower region of the backrest of the seat and a third and a fourth ball joint can be arranged in the front region of the seat surface.

According to a second configuration of the invention, the seat is connected to the seat mechanism only in the front region of its seat surface. In this case, two bending or pivoting zones which are sprung independently of one another can be provided between the backrest and the seat surface, in particular for the relative movement between the backrest and seat surface. According to a preferred configuration of the invention, the seat surface is pivotably mounted on a base support and the backrest is pivotably mounted on the seat surface, wherein a first spring system is provided between the base support and the seat surface and a second spring system is provided between the seat surface and the backrest.

In a further configuration, means for adjusting the spring behaviour of the two spring systems can be provided so that the pivotability of the seat surface in relation to the base support or the pivotability of the backrest in relation to the seat surface can be adapted to different requirements, especially to users of different weights.

According to a third and a fourth embodiment of the invention, the seat mechanism is formed so that it effects mechanical synchronisation of the inclination of the seat surface and the inclination of the backrest.

In a fifth embodiment of the invention, the seat surface and the backrest are formed in one piece, although the left and right sides of the seat are nevertheless movable relative to one another.

Figure 1B:
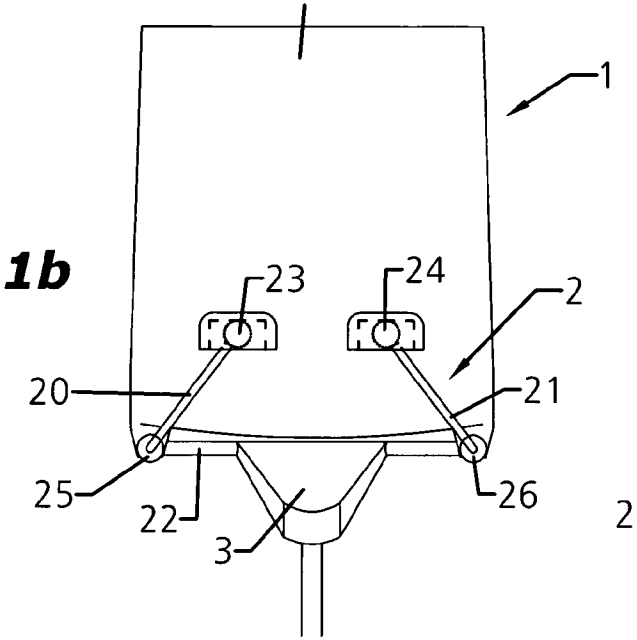
Figure 1C:
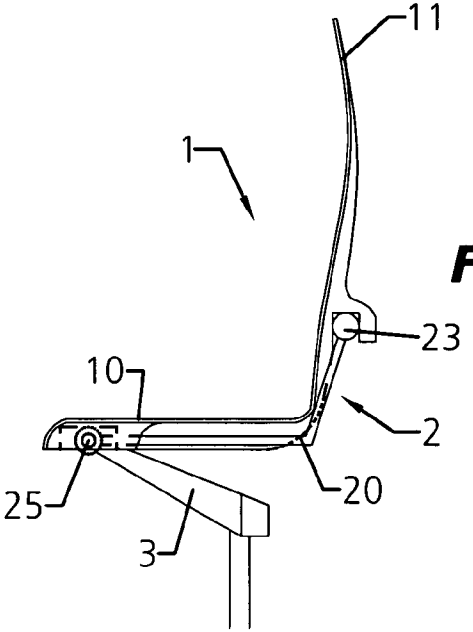
Figure 1D:
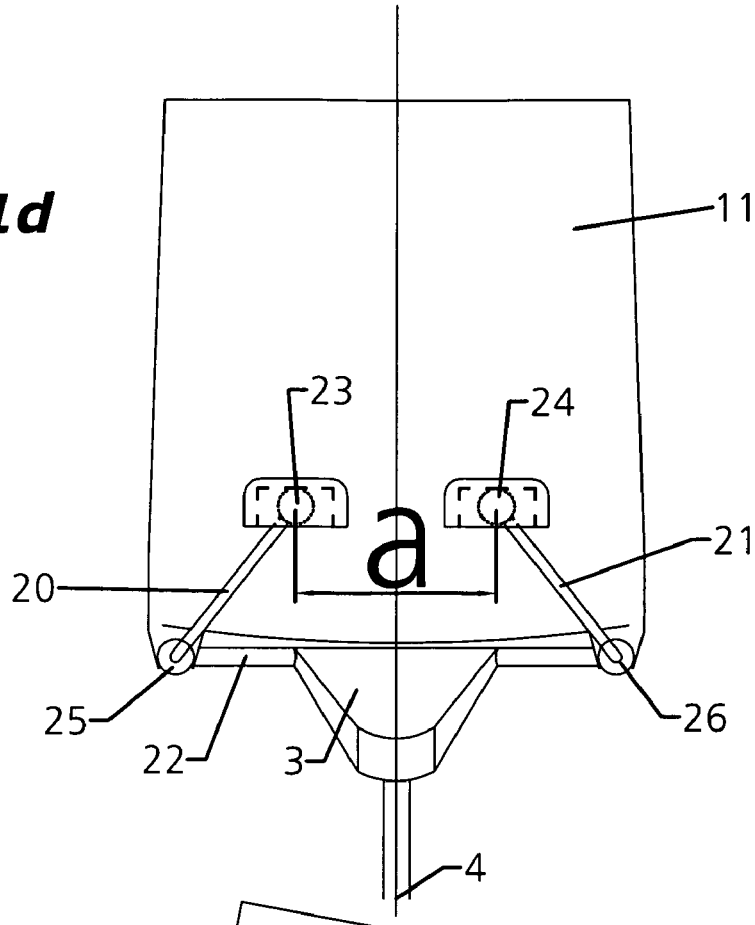
Figure 1E:
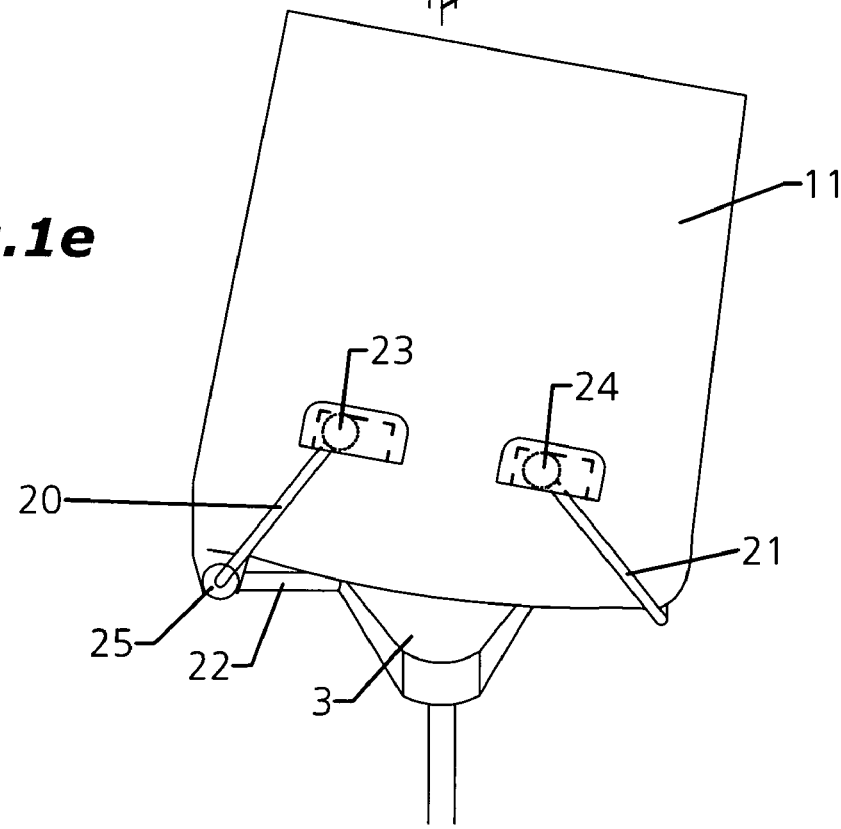
Figure 1G:
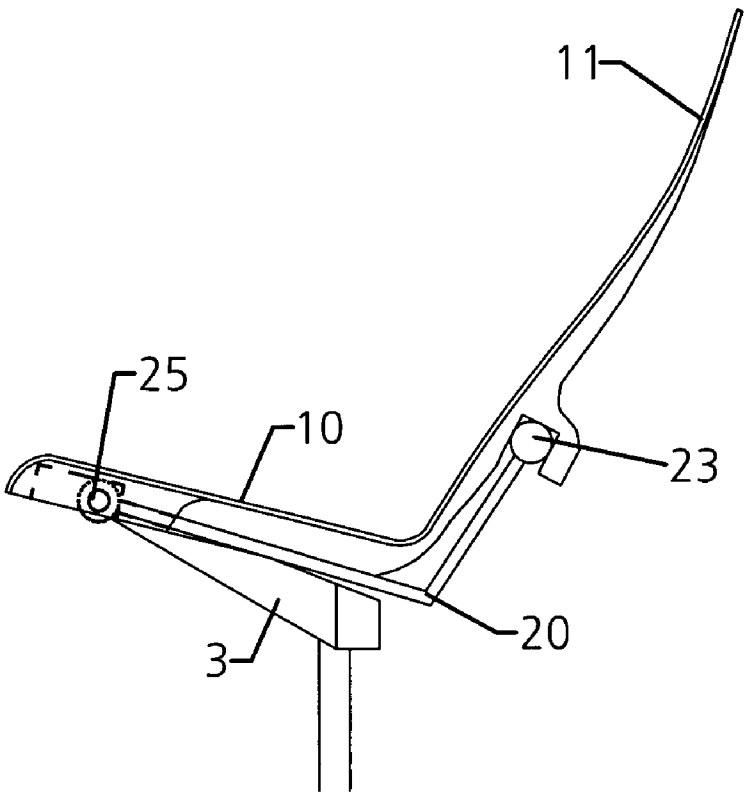
Figure 1F:
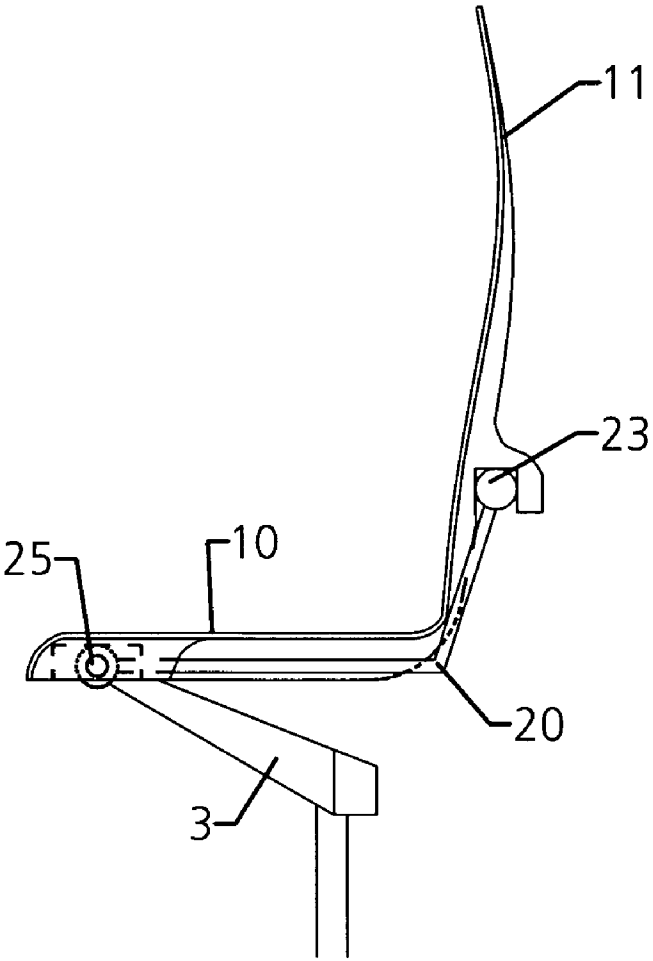
Figure 1H:
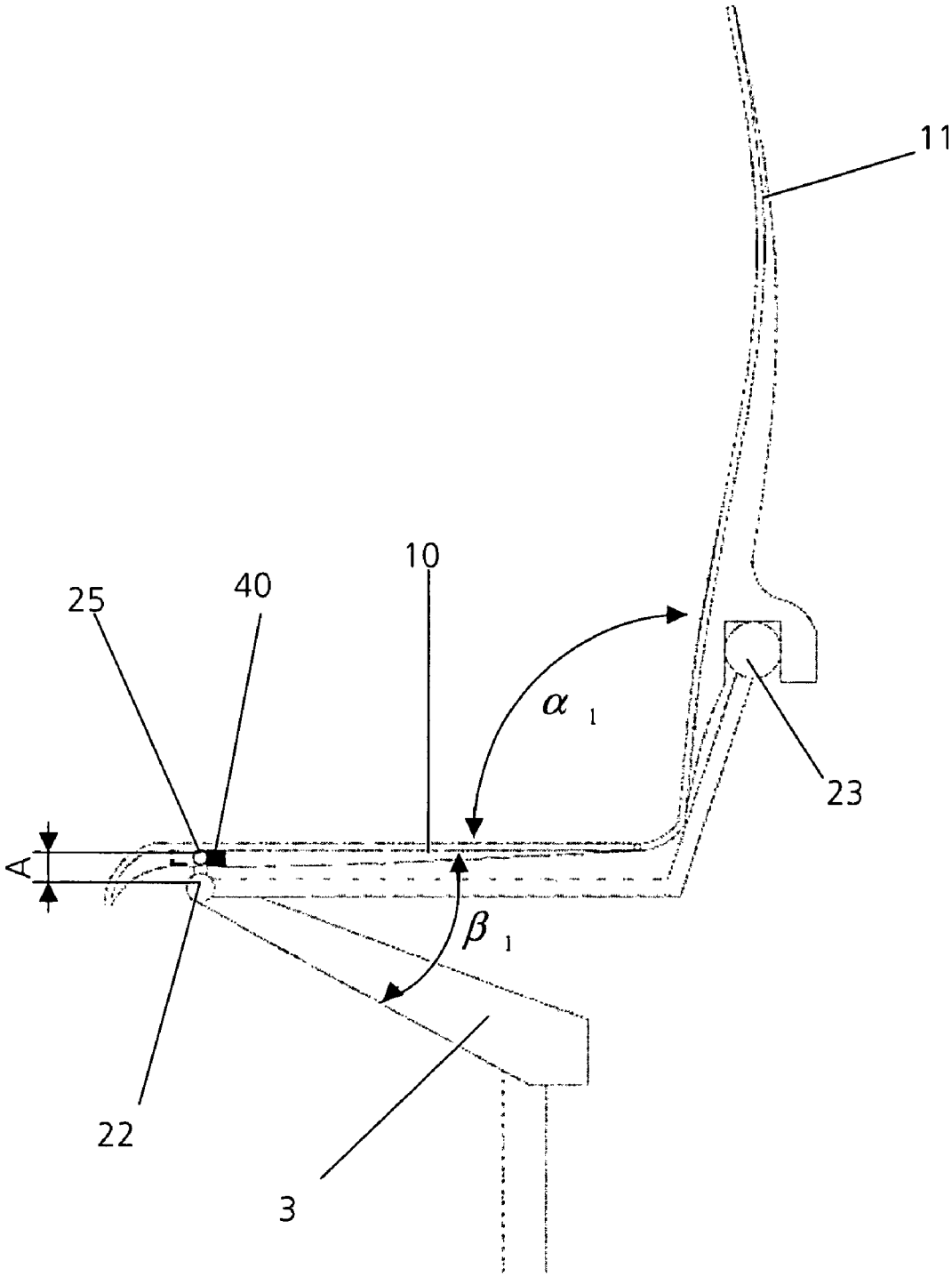
Figure 1I:
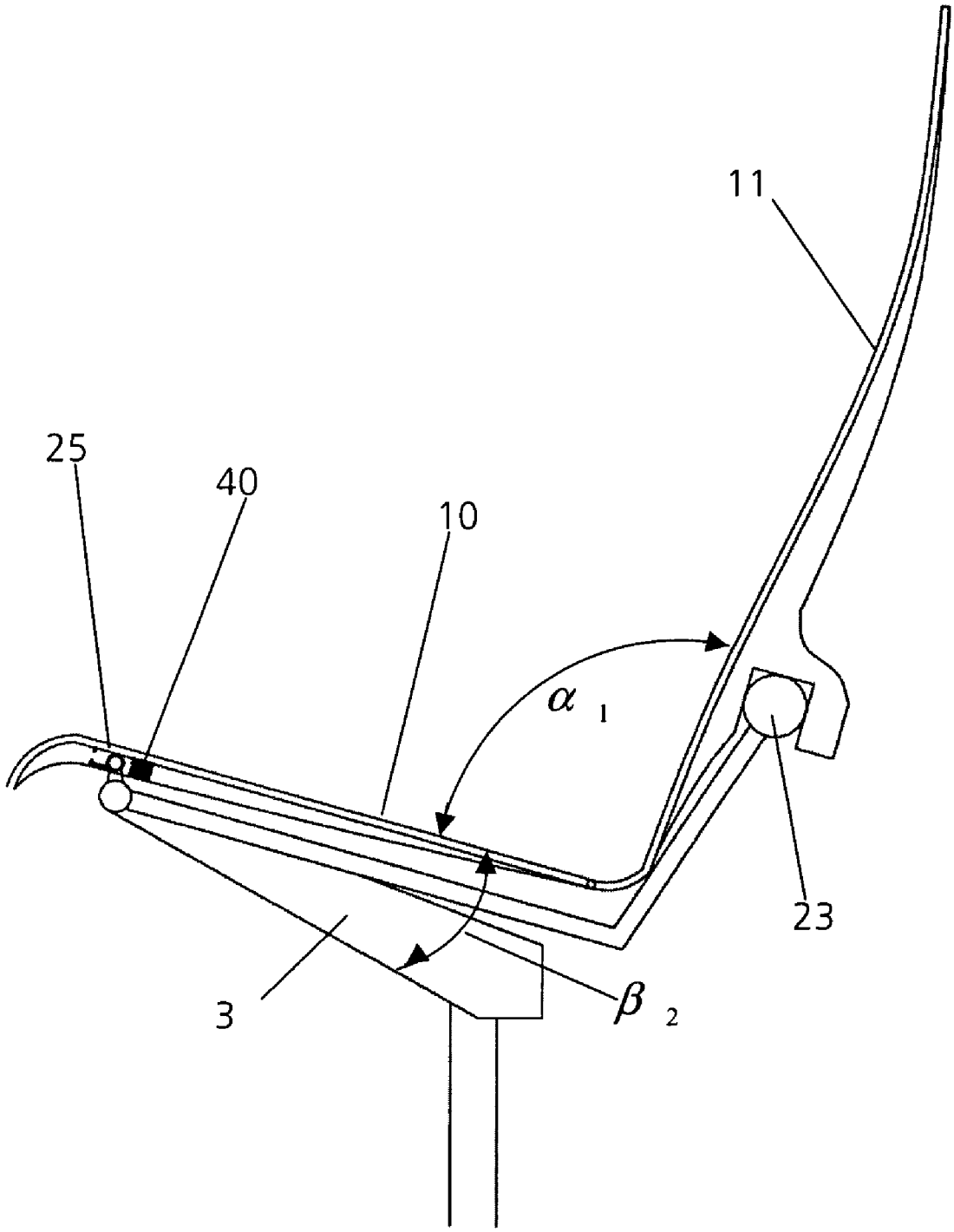
Figure 1J:
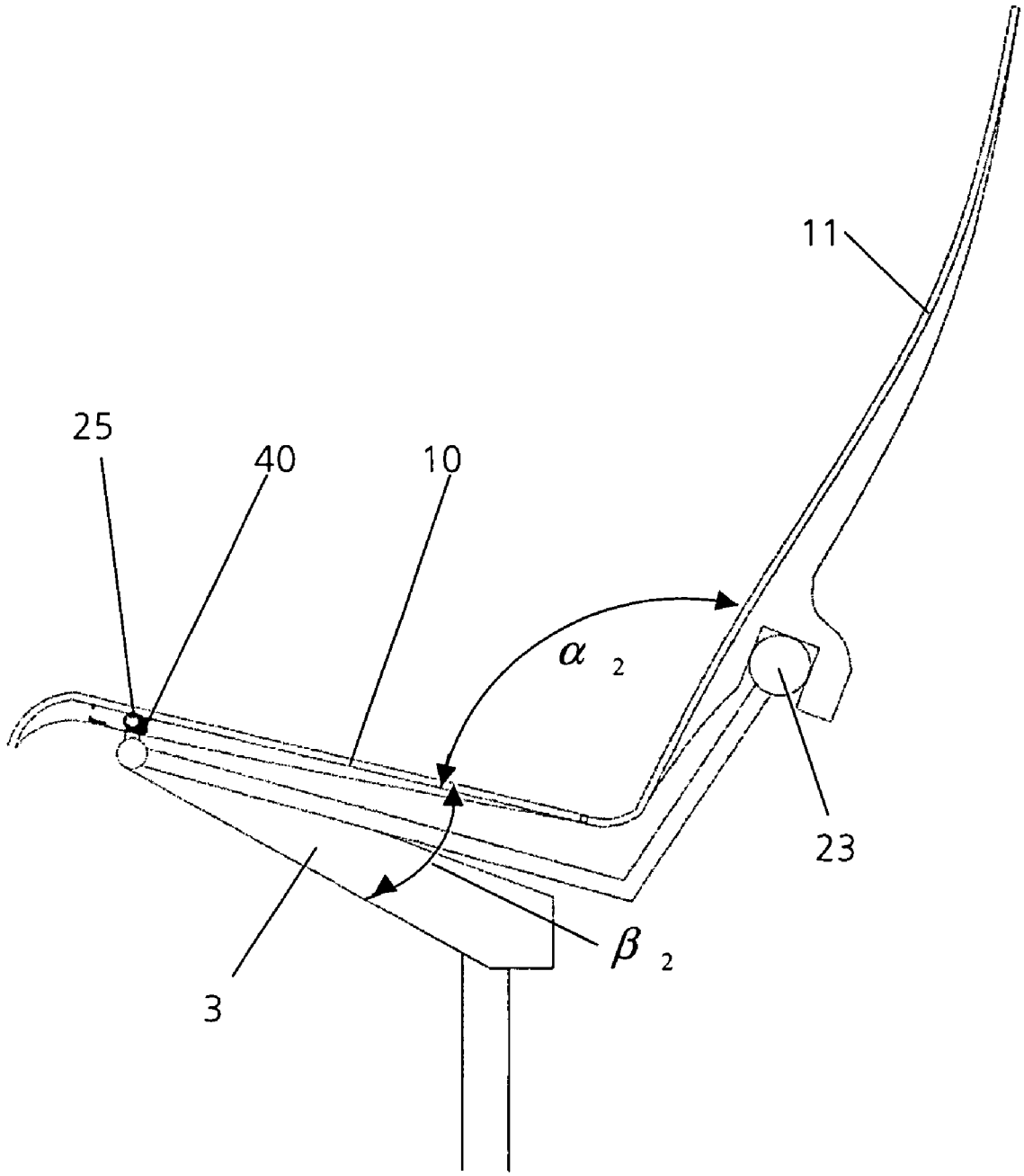
Figure 2A:
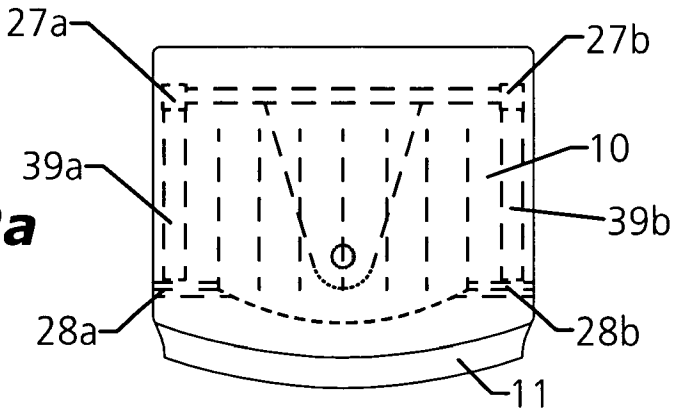
Figure 2B:
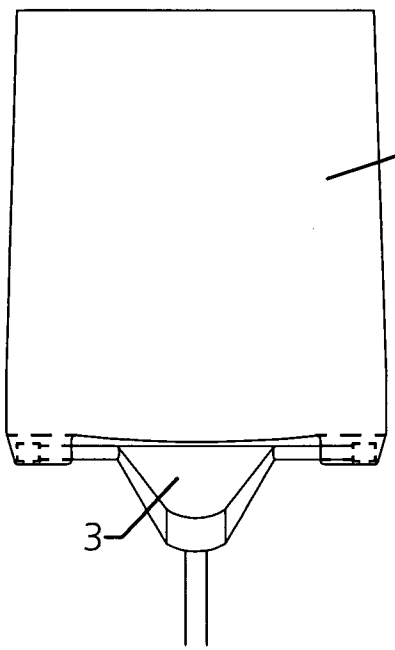
Figure 2C:
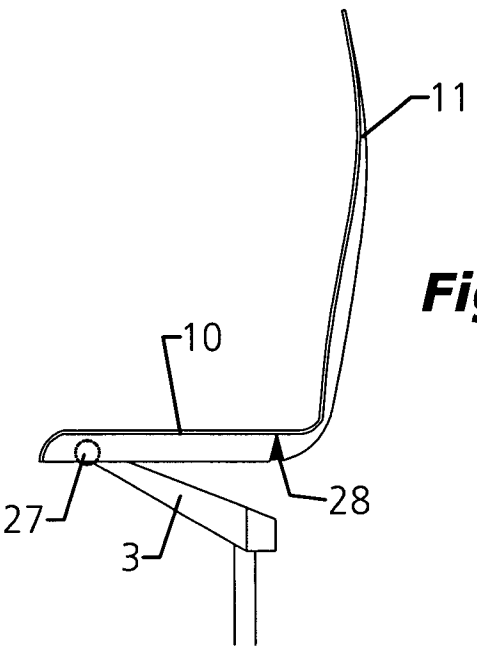
Figure 2D:
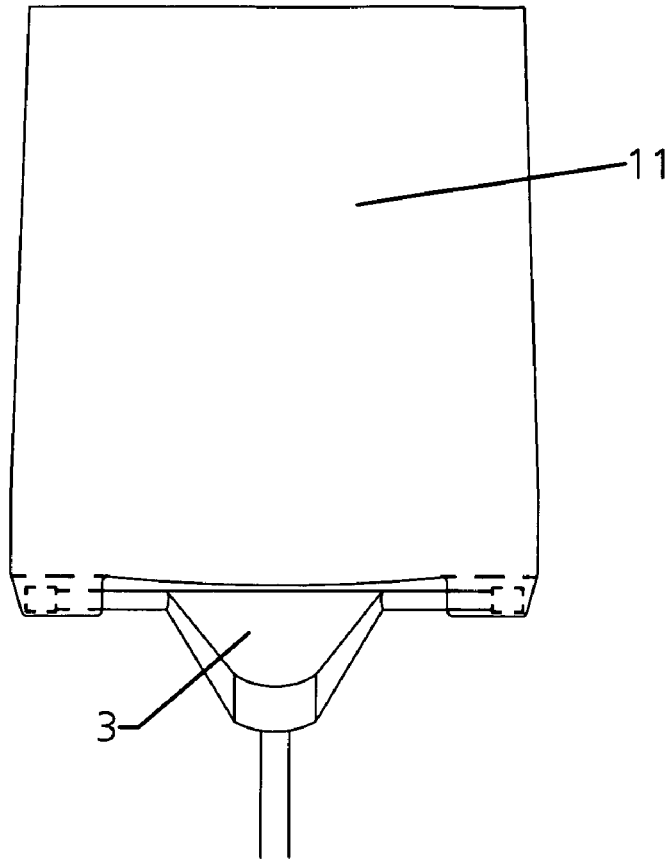
Figure 2E:
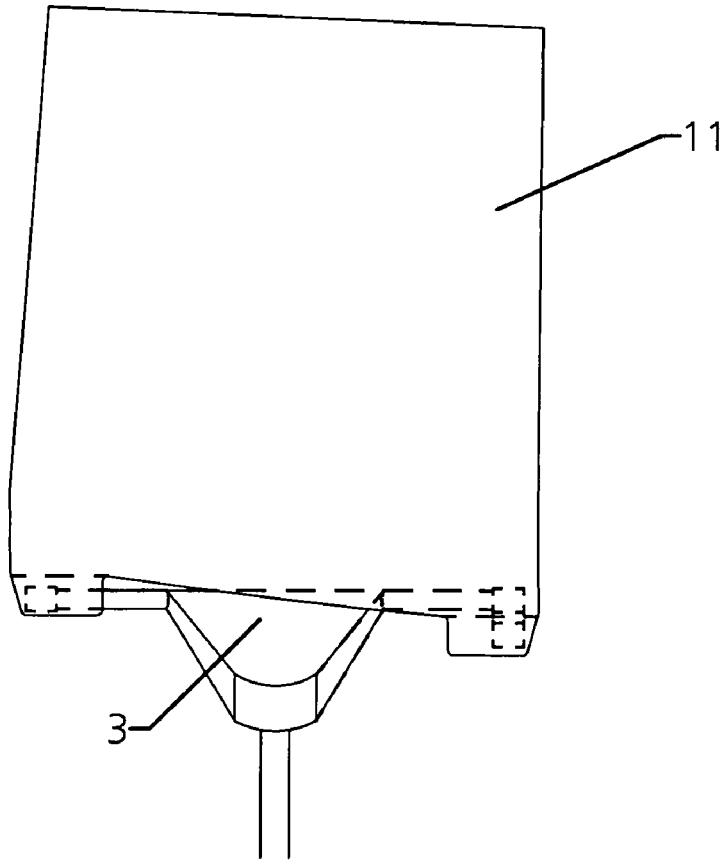
Figure 2F:
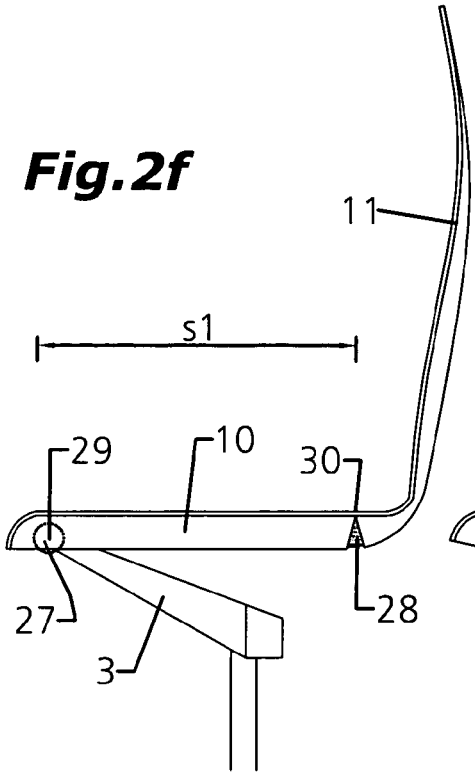
Figure 2G:
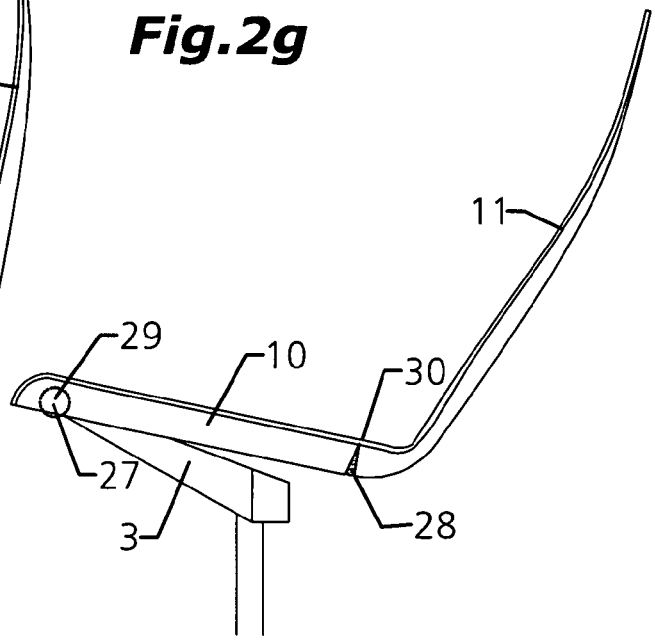
Figure 2H:
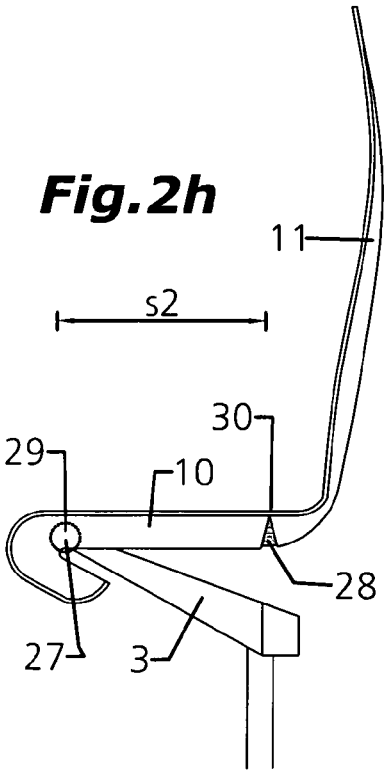
Figure 2I:
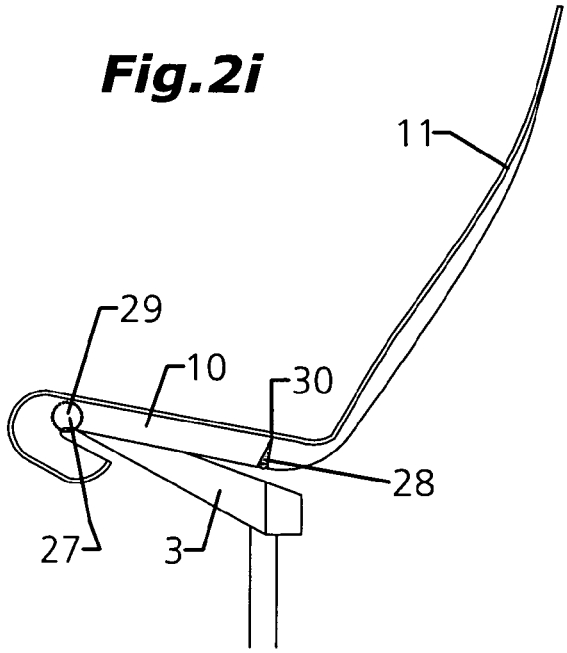

Further advantages and configurations of the invention will be further explained hereinbelow with the aid of the description of a number of embodiments and the drawings, wherein:

FIG. 1*a*-FIG. 1*c* show different views (plan view, rear view, side view) of a chair according to a first embodiment;

FIG. 1*d* and FIG. 1*e* show rear views of the chair in the upright position and the position in which it is tilted sideways;

FIG. 1*f* and FIG. 1*g* show side views of the chair in the normal position and the position in which it is tilted back;

FIG. 1*h* to FIG. 1*j* show side views of the chair in variously inclined positions with means according to a second embodiment;

FIG. 2*a*-FIG. 2*c* show different views (plan view, rear view, side view) of a chair according to a third embodiment;

FIG. 2*d* and FIG. 2*e* show rear views of the chair in the upright position and the position in which it is tilted sideways;

FIG. 2*f* and FIG. 2*g* show side views of the chair in the normal position and the position in which it is tilted back;

FIG. 2*h* and FIG. 2*i* show side views of the chair in the normal position and the position in which it is tilted back, wherein the distance between the two articulation axes is shortened in relation to the illustrations in FIG. 2*f* and FIG. 2*g;*

Figure 3A:
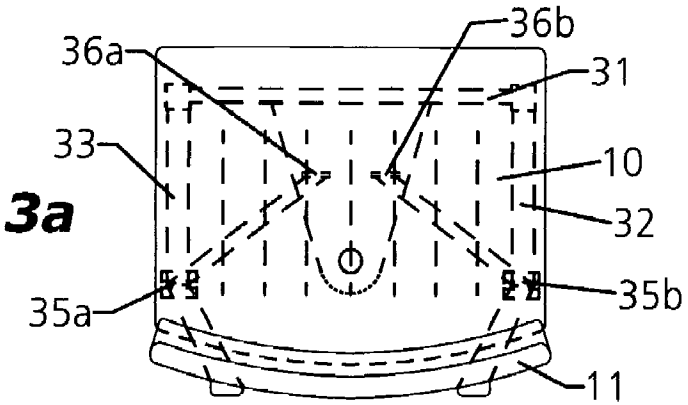
Figure 3B:
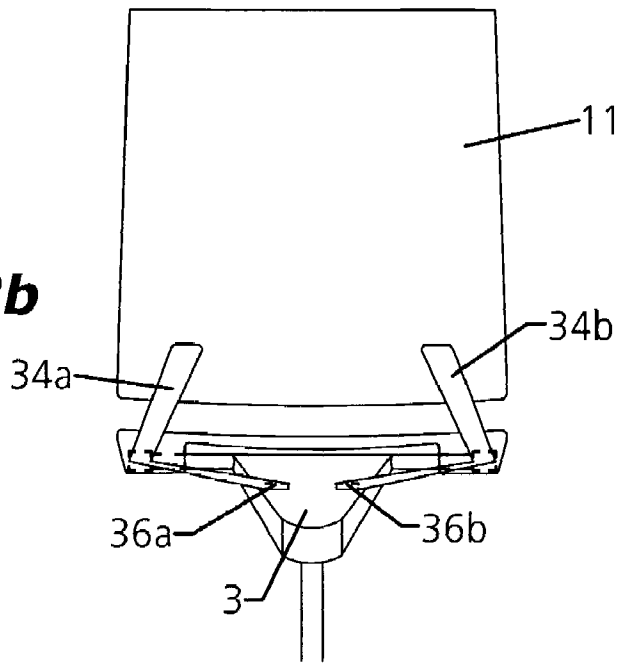
Figure 3C:
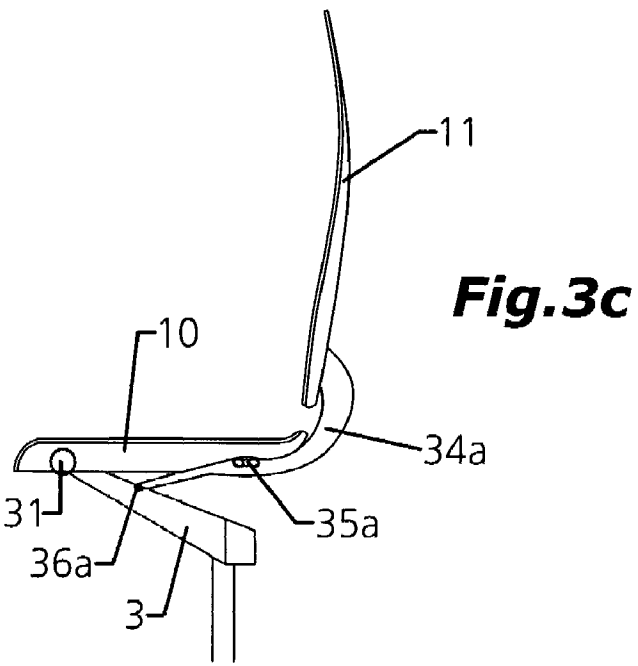
Figure 3D:
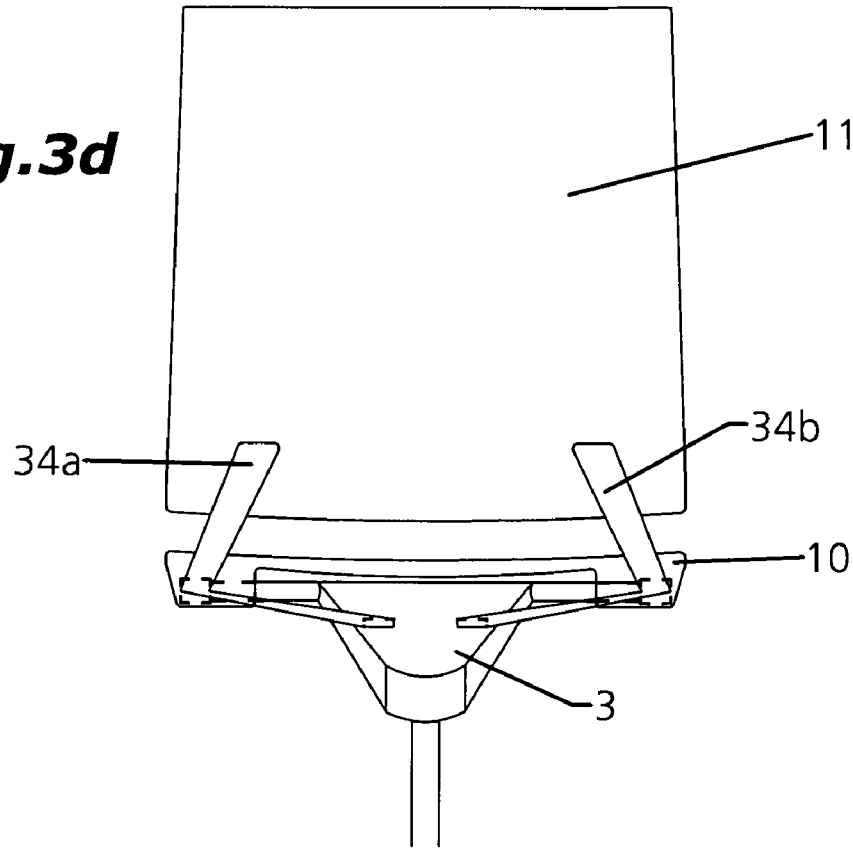
Figure 3E:
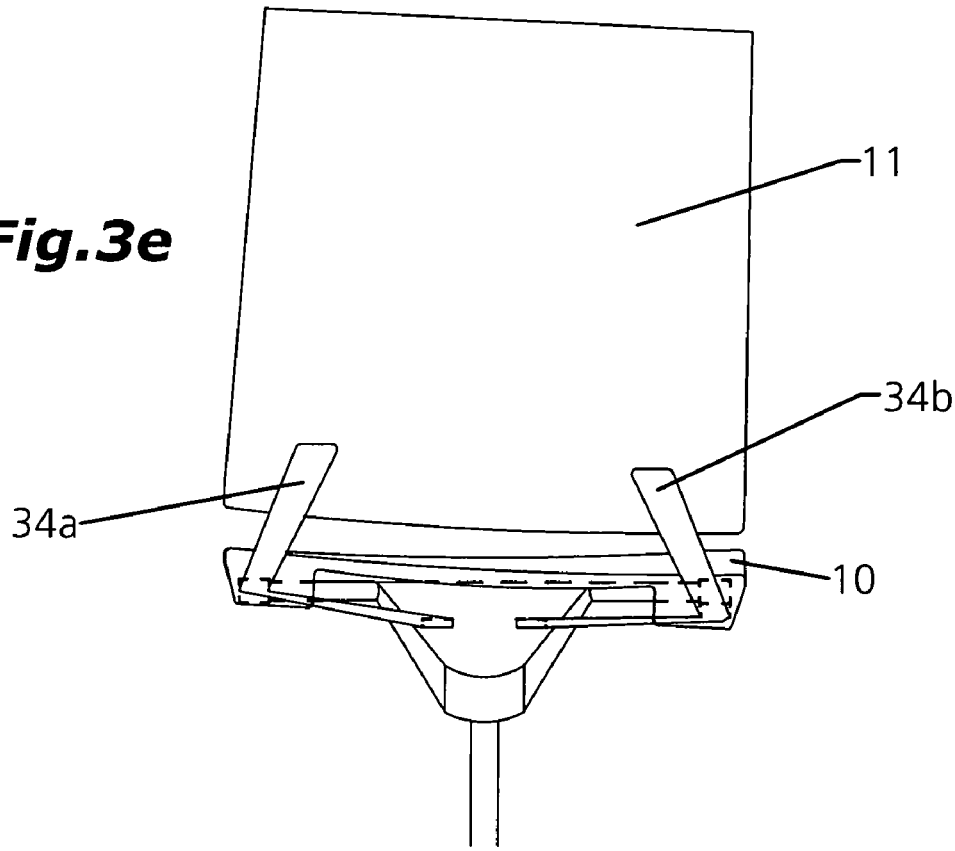
Figure 3G:
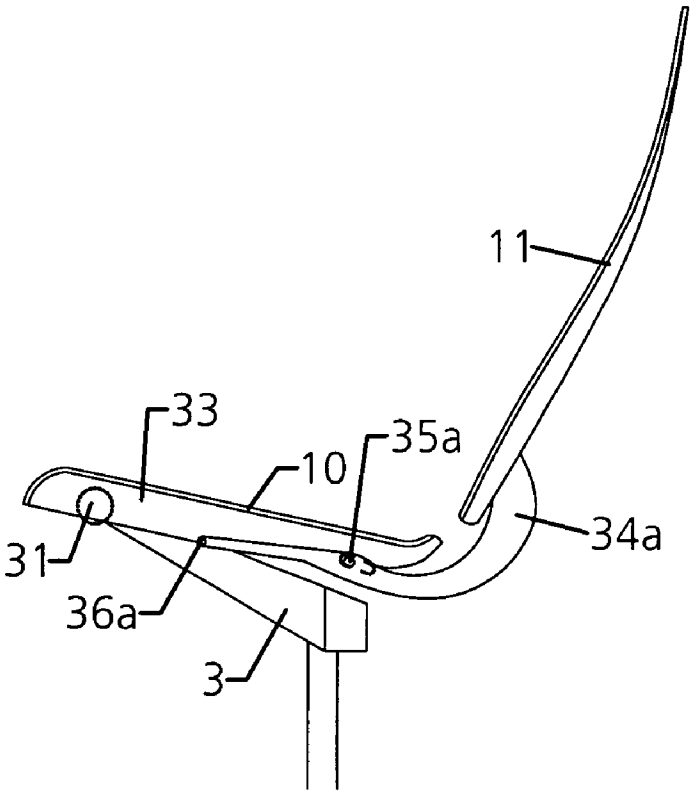
Figure 3F:
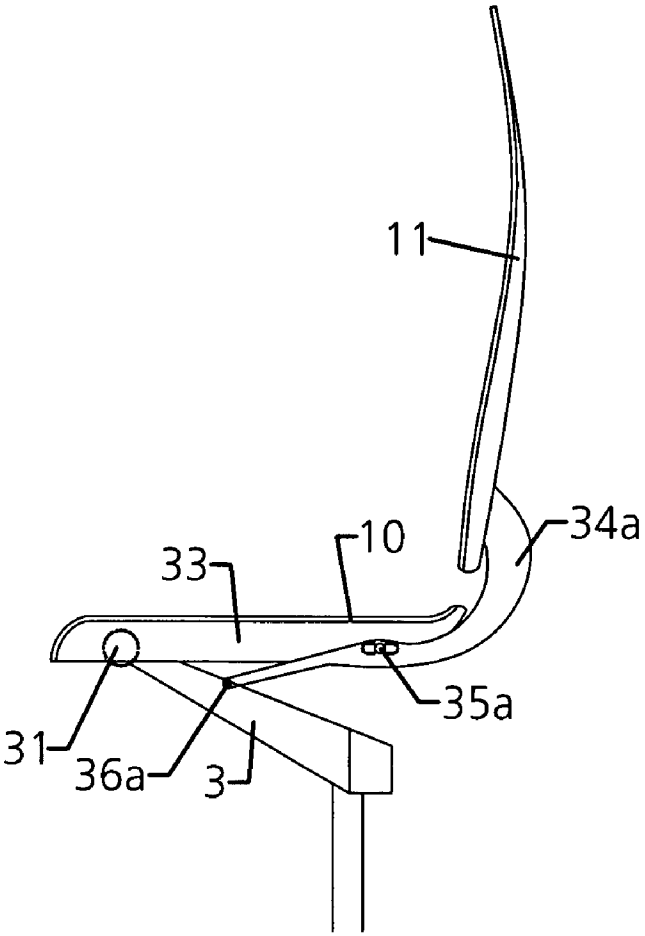
Figure 4A:
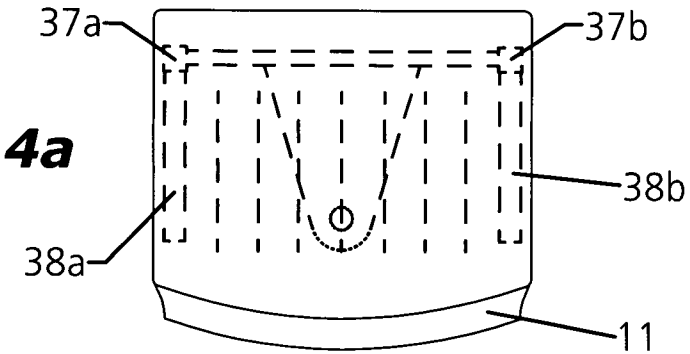
Figure 4B:
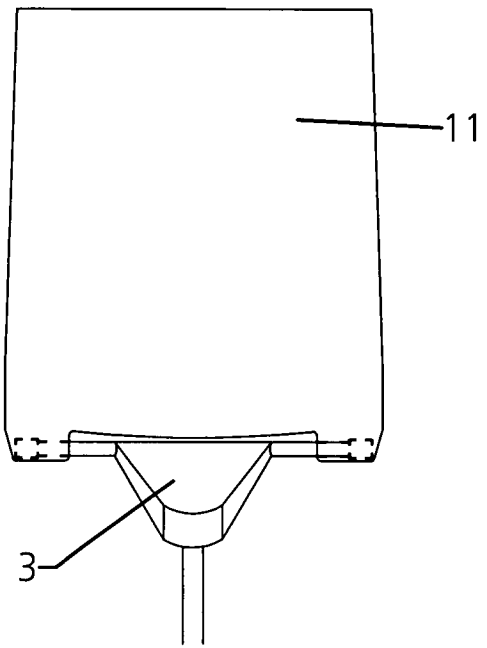
Figure 4C:
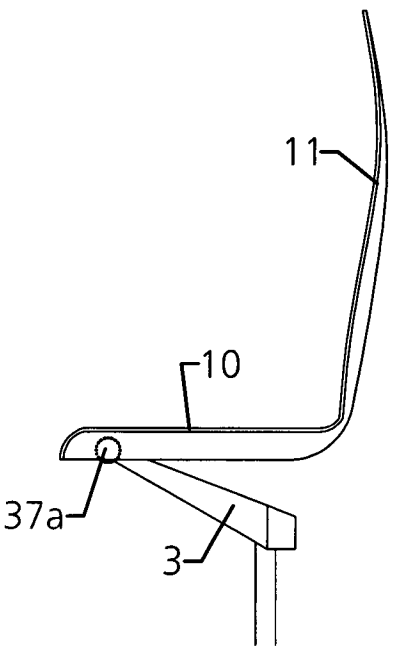
Figure 4D:
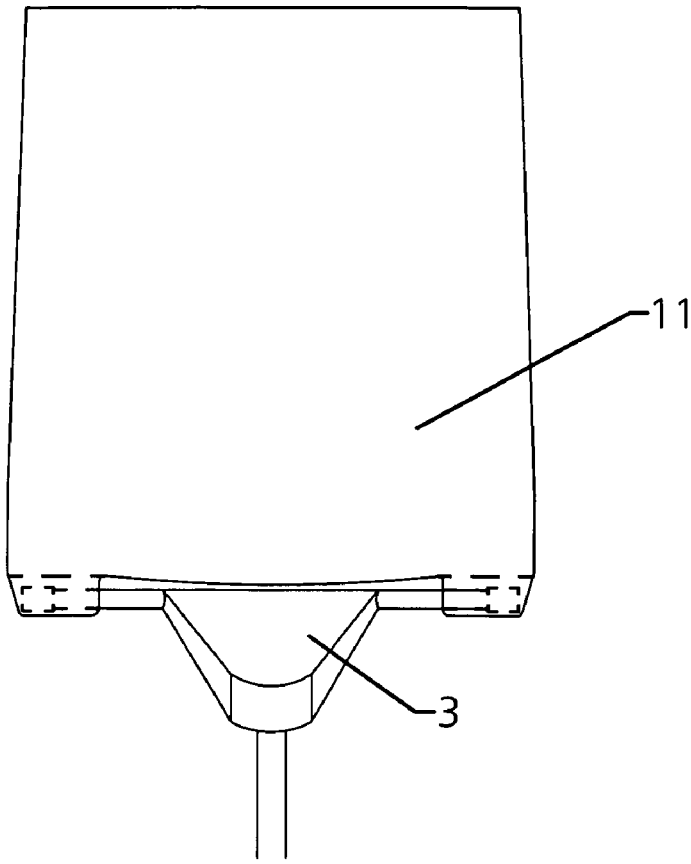
Figure 4E:
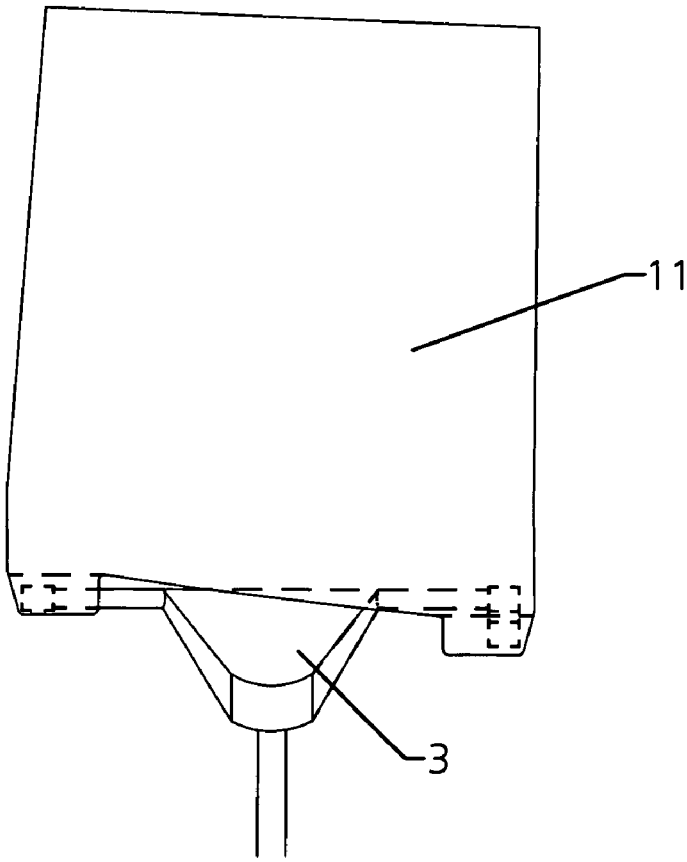
Figure 4G:
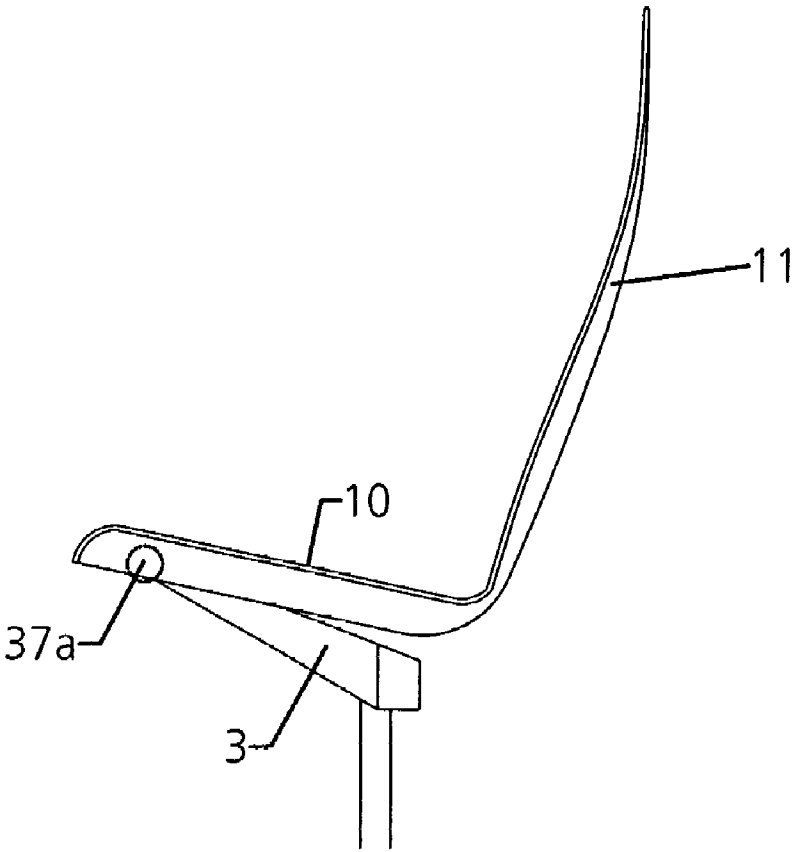
Figure 4F:
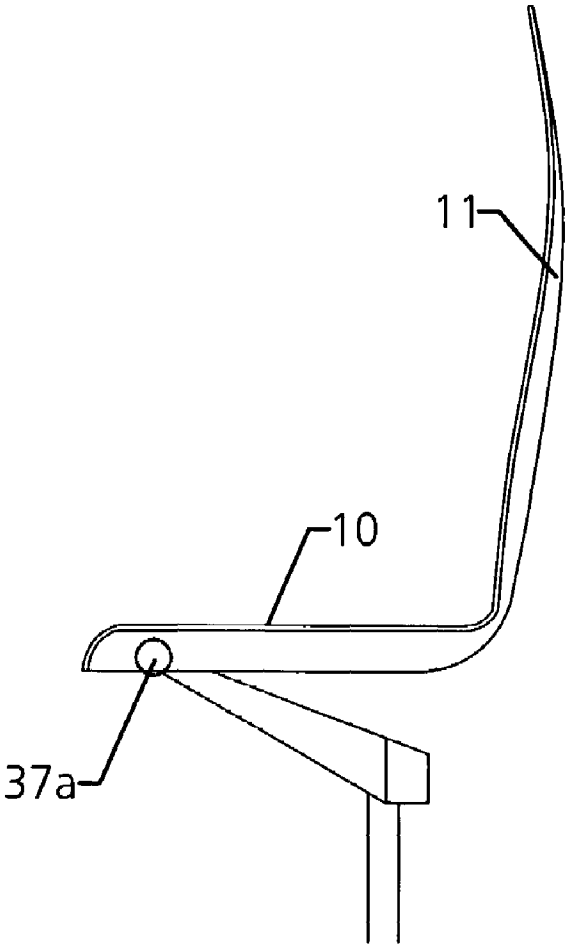

FIG. 3*a*-FIG. 3*c* show different views (plan view, rear view, side view) of a chair according to a fourth embodiment;

FIG. 3*d* and FIG. 3*e* show rear views of the chair in the upright position and the position in which it is tilted sideways;

FIG. 3*f* and FIG. 3*g* show side views of the chair in the normal position and the position in which it is tilted back;

FIG. 4*a*-FIG. 4*c* show different views (plan view, rear view, side view) of a chair according to a fifth embodiment;

FIG. 4*d* and FIG. 4*e* show rear views of the chair in the upright position and the position in which it is tilted sideways;

FIG. 4*f* and FIG. 4*g* show side views of the chair in the normal position and the position in which it is tilted back.

The chair according to a first embodiment, shown in FIG. 1*a* to FIG. 1*g*, substantially comprises a seat 1, a seat mechanism 2 and a base support 3. For its part, the seat has a seat surface 10 and a backrest 11, which are movable relative to one another. The relative movability can be produced by a suitable pivoting or bending zone, wherein the seat surface 10 and the backrest 11 can be formed in one piece or also by separate parts.

The base support usually has a variously designed foot structure and is intended to mount the seat and the seat mechanism.

In the embodiment shown, the seat mechanism 2 has two lateral supporting arms 20, 21 which react independently of one another and to which the seat 1 is fastened. The two supporting arms 20, 21 are mounted so as to be pivotable about a pivoting or rotation axis 22, wherein the pivoting or rotation axis 22 is mounted on the base support 3 so that said pivoting or rotation axis 22 is arranged approximately in the region of the knee axis of a user.

In the embodiment shown, the seat 1 is mounted on the supporting arms 20, 21 by means of ball joints. In this case, a first and a second ball joint 23, 24 are arranged in the lower region of the backrest 11 and a third and a fourth ball joint 25, 26 are arranged in the front region of the seat surface 10. The ball joints 23, 24 and 25, 26 are in each case arranged symmetrically to the centre plane 4 of the chair. The distance of the first and the second ball joint 23, 24 from the hip-joint axis of a user is preferably less than 0.2 m. Furthermore, the distance a between the two ball joints is between 0.1 m and 0.5 m.

Furthermore, the seat surface 10 is displaceably mounted in relation to the supporting arms 20, 21 in the region of the third and fourth ball joint 25, 26 and/or the backrest 11 is displaceably mounted in relation to the supporting arms 20, 21 in the region of the first and second ball joint 23, 24. In the concrete embodiment, displaceability of the third and fourth ball joint 25, 26 is provided and is produced when the backrest pivots rearwards or forwards, as can be seen from FIG. 1*f* and FIG. 1*g*. The pivoting movement of the backrest not only causes forwards displacement of the seat surface, but also effects pivoting of the backrest 11 about the first and second ball joint 23, 24. Moreover, the backrest 11 and the seat surface 10 are coupled together in such a way that rearwards pivoting of the backrest effects lifting of the seat surface in relation to the supporting arms. This lifting of the seat surface takes place principally in the rear part of the seat surface, wherein, as a result of the supporting arms being lowered at the same time, a downwards movement of the rear part of the seat surface 10 is effected overall.

The rearwards pivoting movement of the backrest 11 is therefore substantially produced by the pivoting movement of the supporting arms 20, 21 about the pivoting or rotation axis 22. In addition, the displaceability of the ball joints 25, 26 permits enlargement of the angle between the seat surface 10 and the backrest 11 when the user leans back.

According to a second embodiment, the ball joints 25 and 26 are arranged at a distance A from the pivoting or rotation axis 22. The seat surface 10 is mounted so as to be displaceable forwards or rearwards in relation to the ball joints 25, 26, wherein rearwards displacement is possible without resistance, while forwards displacement is limited by a boundary 40. The boundary 40 can be formed by a rigid or compressible stop.

FIG. 1*i* shows that the seat can be fully inclined or tilted without resistance and without the backrest having to rotate about the ball joints 23, 24. The angle $\alpha 1$ between the seat surface 10 and the backrest 11 can therefore be kept constant during this tilting movement.

Rotation of the backrest 11 is always also combined with displacement of the seat surface in relation to the ball joints 25 and 26. As can clearly be seen from FIG. 1*h*, the ball joints 25 and 26 are in contact with the boundary 40, with the result that it is not possible for the backrest alone to rotate out of this position about the joints 23, 24. It is therefore necessary that the seat surface is for its part pushed downwards by the pressure of the boundary 40 against the ball joints 25, 26.

This design produces mechanical synchronisation of the inclination of the seat surface and the inclination of the backrest ($\beta 1$-$\beta 2$/($\alpha 2$-$\alpha 1$), this synchronisation only being effective in one direction. For the user, this has the advantage that he is comfortably cushioned by the free tilting when he sits down on the chair, without losing contact with the backrest, and that, when he leans back, mechanical synchronisation of the inclination of the seat surface and the inclination of the backrest with a harmonic and defined path is still available to him.

In connection with the feature of the independent movement of the left and right sides of the seat, this second embodiment of the invention is capable of reacting to sideways shifts in weight by means of unilateral tilting of the seat surface, without the user losing contact with the backrest.

The two supporting arms 20, 21 are pushed by suitable spring members into the normal position, i.e. into the upright position, as shown in FIG. 1*f*. In the conventional form, the spring members are individually adjustable by the user so that the pivoting behaviour can thereby be changed.

The two supporting arms can pivot both jointly, i.e. synchronously without the pivoting or rotation axis 22, and independently of one another about the pivoting or rotation axis 22. This independent pivotability allows the seat to pivot sideways as shown in FIG. 1*e*, in contrast to the upright position according to FIG. 1*d*. In addition to the supporting arms 20, 21 reacting independently of one another, the seat itself is also formed so that one side, i.e. the left or right side of the seat, is movable independently of the respective other side of the seat during the sideways pivoting movement. In other words, the seat is not tilted sideways in its entirety, but in particular an independent movement of the left and right halves of the seat, in particular the seat surface, is produced. In the embodiment shown, the pivoting or rotation axis 22 is rigidly formed, and the articulation on the seat also allows only approximately horizontal displacement of the seat, but does not allow the seat to be lowered in its front region. When the seat is pivoted sideways, as shown in FIG. 1*e*, torsion of the seat, in particular the seat surface, therefore occurs. Naturally, this can additionally also be combined with pivoting and/or torsion of the backrest during this movement.

A third embodiment will be described hereinbelow with reference to FIG. 2*a* to FIG. 2*i*.

For easier comprehension, the same reference numerals as in the first embodiment will be used for the same components.

In this case, the seat 2 is connected to the seat mechanism only in the front region of its seat surface 10, wherein the seat surface 10 is pivotably mounted on the base support 3 and the backrest is pivotably mounted on the seat surface 10. The seat mechanism here is substantially formed by two spring systems, wherein a first spring system 27 is provided between the base support 3 and the seat surface 10 and a second spring system 28 is provided between the seat surface 10 and the backrest 11. Further configurations of this seat mechanism are disclosed in DE-A-10 2006 023 982, which belongs to the same applicant.

If the pivoting movement of the backrest 11 in relation to the seat surface 10 is not mechanically coupled to the pivoting movement of the seat surface 10 in relation to the base support, the chair can be individually adapted to diverse requirements in both pivoting regions. By omitting the mechanical coupling between the two articulations, less installation space is needed for the chair mechanism and new chair design possibilities are opened up.

Furthermore, means (not shown in further detail) can be provided for adjusting the spring behaviour of the two spring systems 27, 28 so that the pivotability of the seat surface 10 in relation to the base support 3 or the pivotability of the backrest 11 in relation to the seat surface 10 can be adapted to different requirements, especially to users of different weights. In particular, means which adjust both spring systems 27, 28 jointly are also conceivable, as described in further detail in DE-A-10 2006 023 962 in particular. In this way it can be ensured that, even for users of different weights, substantially the same synchronisation relationship between the inclination of the seat surface and the inclination of the backrest is rendered possible.

The seat surface 10 is pivoted in relation to the base support 3 about a first articulation axis 29 and the backrest 11 is pivoted in relation to the seat surface 10 about a second articulation axis 30. The omission of the mechanical coupling between the seat surface and the backrest provides the possibility of adjusting the distance between the two articulation axes 29, 30 in order to effect adjustment of the seat depth. In FIG. 2*f* and FIG. 2*g*, the seat depth (i.e. the distance between the two articulation axes 29, 30) is $s_1$, while in FIGS. 2*h* and 2*i* the seat depth has been reduced to $s_2$.

Furthermore, sideways pivotability of the seat is also provided in this embodiment. For this purpose, two lateral supporting arms 39*a*, 39*b* are again provided and are pivotable independently of one another via two independent spring members 27*a*, 27*b*. The spring system 28 is also provided with two lateral spring members 28*a*, 28*b* reacting independently of one another. In this way, during the sideways pivoting movement of the seat, one side of the seat can again move independently of the other side of the seat, as can be seen from FIG. 2*d* and FIG. 2*e*.

Moreover, the seat surface 10 and preferably also the backrest 11 are formed so that torsion of the seat surface and the backrest can occur during the sideways pivoting movement.

A fourth embodiment of a chair will be further described hereinbelow with reference to FIG. 3*a* to FIG. 3*e* and is distinguished by a seat mechanism which effects mechanical synchronisation of the inclination of the seat surface and the inclination of the backrest. The front region of the seat surface 10 is again mounted on the base support 3 so as to be pivotable about an articulation axis 31. The backrest 11 is laterally articulated on the seat surface 10 by means of two lateral coupling arms 34*a*, 34*b* via joints 35*a*, 35*b*. An extension of the coupling arms 34*a*, 34*b* is additionally coupled to the base support 3 by means of joints 36*a*, 36*b*.

This synchronisation mechanism is adapted so that a suitable synchronisation relationship is produced, for example in the range from 1:1.5 to 1:3.5. The synchronisation relationship is produced from the ratio of the angle at which the seat surface 10 is inclined in relation to the base support 3 and the angle at which the backrest 11 is inclined in relation to its upright position. As a generality, the synchronisation mechanism can also be formed in any other manner as long as it effects mechanical synchronisation of the inclination of the seat surface and the inclination of the backrest.

To fasten the seat surface 10 to the articulation axis 31, two lateral supporting arms 32, 33 are again provided which are mounted so as to be pivotable about the articulation axis 31 independently of one another and are connected to the seat surface in a suitable manner. The independent pivotability of these two supporting arms again allows one side of the seat to move independently of the other side of the seat during a sideways pivoting movement thereof. As the front end of the seat does not tilt sideways, torsion of the seat surface 10 and also corresponding torsion of the backrest 11 via the coupling arms 34*a*, 34*b* occurs, as in the other embodiments.

The fifth embodiment shown in FIG. 4*a* to FIG. 4*g* differs from the third embodiment substantially only in that the second spring system 28 provided in the latter has been omitted.

The seat surface 10 and the backrest 11 are formed in one piece, wherein a transition region between the seat surface 10 and the backrest 11 provides relative movability of the seat surface and the backrest. The sideways pivotability of the seat is again achieved by the seat 10 being articulated and sprung in its front region by two lateral spring members 37*a*, 37*b* reacting independently of one another. As in the preceding embodiments, the connection between the seat surface 10 and the base support 3 can be established by means of lateral supporting arms 38*a*, 38*b* which are movable independently of one another by the two spring members 37*a*, 37*b*. The seat shell, which is formed in one piece and comprises the seat surface 10 and the backrest 11, is advantageously manufactured from a plastics material and can be adapted accordingly to produce the sideways pivotability of the seat (see FIG. 4*e*).

In all embodiments, the seat surface 10 is pivotable at its front end about an articulation axis, wherein separate spring members are provided in the region of this articulation axis 2 and allow the left and right sides of the seat to pivot independently about the front articulation axis. The seat is preferably fastened to two lateral supporting arms reacting independently of one another about the front articulation axis.

The invention claimed is:

1. A chair comprising:

a seat, a base support for the seat, and a seat mechanism, wherein the seat mechanism permits a sideways pivoting movement of the seat, wherein the seat and the seat mechanism are formed so that, during the sideways pivoting movement of the seat, one side of the seat is movable independently of the other side of the seat, and wherein the seat mechanism is formed so that the seat is mounted so as to be pivotable relative to the base support about a rotation axis lying parallel to the knee axis of the user and at a front end of the seat.

2. A chair according to claim 1, characterized in that the seat has a seat surface and a backrest, wherein the backrest and the seat surface are movable relative to one another.

3. A chair according to claim 2, characterized in that the seat is connected to the seat mechanism only in the front region of its seat surface.

4. A chair according to claim 3, characterized in that, for the relative movement between the backrest and the seat surface, two bending or pivoting zones which are sprung independently of one another are provided between the backrest and the seat surface.

5. A chair according to claim 2, characterized in that the seat surface is pivotably mounted on a base support and the backrest is pivotably mounted on the seat surface, and a first spring system is provided between the base support and the seat surface and a second spring system is provided between the seat surface and the backrest.

6. A chair according to claim 5, characterized in that means for adjusting the spring behaviour of the two spring systems are provided so that one of the pivotability of the seat surface in relation to the base support or the pivotability of the backrest in relation to the seat surface can be adapted to different requirements.

7. A chair according to claim 2, characterized in that the seat mechanism is formed so that it effects mechanical synchronisation of the inclination of the seat surface and the inclination of the backrest.

8. A chair according to claim 2, characterized in that the seat surface and the backrest are formed in one piece, wherein the left and right sides of the seat are movable relative to one another.

9. A chair according to claim 2, characterized in that the seat surface is mounted on a base support so as to be pivotable about a first articulation axis and the backrest is mounted on the seat surface so as to be pivotable about a second articulation axis, wherein the two articulation axes are displaceably arranged relative to one another.

10. A chair according to claim 1, characterized in that the seat mechanism has two lateral supporting arms which react independently of one another and to which the seat is fastened.

11. A chair according to claim 10, characterized in that the two supporting arms are pivotably mounted in the region of the knee axis of a user.

12. A chair according to claim 10, characterized in that the seat is mounted on the supporting arms by means of ball joints.

13. A chair according to claim 12, characterized in that a first and a second ball joint are arranged in the lower region of a backrest of the seat and a third and a fourth ball joint are arranged in the front region of a seat surface of the seat.

14. A chair according to claim 13, characterized in one of: that the seat surface is displaceably mounted in relation to the supporting arms in the region of the third and fourth ball joint, or that the backrest is displaceably mounted in relation to the supporting arms in the region of the first and second ball joint.

15. A chair according to claim 13, characterized in that the backrest is pivotable about the first and second ball joint, and the backrest and the seat surface are coupled together in such a way that rearwards pivoting of the backrest effects lifting of the seat surface in relation to the supporting arms.

16. A chair according to claim 12, characterized in that two ball joints are arranged symmetrically to the centre plane of the chair in such a way that their distance from the hip joint of a user is less than 0.2 m and the distance between each other is between 0.1 m and 0.5 m.

* * * * *